US009010435B2

(12) United States Patent
Matsur

(10) Patent No.: US 9,010,435 B2
(45) Date of Patent: Apr. 21, 2015

(54) METHOD AND DEVICE FOR EMERGENCY KILLING OF AN UNDERWATER OIL/GAS WELL

(76) Inventor: Igor Yurievich Matsur, Tula (RU)

( * ) Notice: Subject to any disclaimer, the term of this patent is extended or adjusted under 35 U.S.C. 154(b) by 222 days.

(21) Appl. No.: 13/809,645

(22) PCT Filed: May 11, 2011

(86) PCT No.: PCT/RU2011/000319
§ 371 (c)(1),
(2), (4) Date: Jan. 11, 2013

(87) PCT Pub. No.: WO2012/008870
PCT Pub. Date: Jan. 19, 2012

(65) Prior Publication Data

US 2013/0118756 A1 May 16, 2013

(30) Foreign Application Priority Data

Jul. 14, 2010 (RU) ..... 2010129040

(51) Int. Cl.

| | |
|---|---|
| ***E21B 7/12*** | (2006.01) |
| ***E21B 33/035*** | (2006.01) |
| ***E21B 33/02*** | (2006.01) |
| ***E21B 33/068*** | (2006.01) |
| ***E21B 33/076*** | (2006.01) |
| ***E21B 33/13*** | (2006.01) |
| ***E21B 43/01*** | (2006.01) |

(52) U.S. Cl.
CPC ..... *E21B 33/035* (2013.01); *E21B 33/02* (2013.01); *E21B 33/068* (2013.01); *E21B 33/076* (2013.01); *E21B 33/13* (2013.01); *E21B 43/0122* (2013.01)

(58) Field of Classification Search
CPC ... E21B 33/035; E21B 33/068; E21B 33/076; E21B 33/13; E21B 43/0122
USPC ..... 166/351, 363, 285, 386, 192
See application file for complete search history.

(56) References Cited

U.S. PATENT DOCUMENTS 2,922,478 A * 1/1960 Maly ..... 166/154
4,616,987 A * 10/1986 Boyers et al. ..... 425/89

(Continued)

FOREIGN PATENT DOCUMENTS

| | | |
|---|---|---|
| RU | 2010951 | 4/1994 |
| RU | 2100567 | 12/1997 |
| SU | 1458560 | 2/1989 |

OTHER PUBLICATIONS

Search report in PCT/RU 2011/000319, dated Sep. 22, 2011.

*Primary Examiner* — Matthew Buck
*Assistant Examiner* — Aaron Lembo
(74) *Attorney, Agent, or Firm* — Bardmesser Law Group

(57) ABSTRACT

The invention relates to oil-and-gas industry and can be used in emergency killing of wells. The method of emergency killing of a well of underwater head position comprises a cementing composition squeezing, wherein depth of the well section to be cemented is defined basing on the well condition and pressure in it, an injector, fixed on the tank with cementing composition and placed inside a bag made of some flexible material, is bottomed and inserted into the wellhead, the bag being filled with cementing composition which is squeezed into the bag through the injector from the tank, and providing for a firm contact of outer surface of the bag with inner surface of the well, the injector being kept at a target depth by means of the weight of the whole structure filled with the cementing composition, pressure in the bag being maintained till the cementing composition hardening.

20 Claims, 3 Drawing Sheets

(56) References Cited

U.S. PATENT DOCUMENTS 5,435,388 A 7/1995 Matthews
6,615,923 B1 * 9/2003 Lay et al. ..... 166/368
7,108,006 B2 * 9/2006 Armstrong ..... 137/14
7,717,179 B2 * 5/2010 Rayssiguier et al. ..... 166/285
7,735,567 B2 * 6/2010 O'Mally et al. ..... 166/387

* cited by examiner

METHOD AND DEVICE FOR EMERGENCY KILLING OF AN UNDERWATER OIL/GAS WELL

FIELD OF INVENTION

The invention relates to the oil and gas industry and can be used for emergency killing of wells.

DESCRIPTION OF CONVENTIONAL ART

A method of isolation of thief zones in wells is known, in which a gradual squeezing of A viscoelastic material and cement slurry into a thief zone of the well, such as a cement slurry squeezing, is performed. The viscoelastic material in the well is cured until it gels and acquires its structural strength of at least 80 percent of its maximum (see RU 2111337). This method can be used to kill wells under relatively benign conditions. This method suffers from a disadvantage due to an impossibility of using it for killing an underwater flowing well when the well is not isolated from the surrounding water medium. Such a situation can occur, for instance, in case of failure of an underwater well when a preventer is broken.

An inflatable cementer unit is also known, which consists of a first expandable tubular element with a pair of ends, the first pair of ring terminal supports to fix corresponding ends of the first tubular element relative to the mandrel located in the first tubular element, one of the terminal supports being mobile and the other terminal support being fixed relative to the mandrel, and the first fixing ring unit deploying from one of the terminal supports to reinforce the first tubular element while creating pressure inside it and its extension, hinged to one of the terminal supports with one of its ends to reinforce the first tubular element while creating pressure inside it and its extension, capable of expansion at its other end and containing many plates disposed in a ring configuration, hinged to mobile terminal support with one of their ends and each having a width increasing from its hinged end to its other end (see RU 2384692).

This conventional device can be used for some temporary isolation of a part of a borehole, but cannot be used for killing a flowing well, as it does not have a means either to introduce a kill fluid into the hole at a necessary depth with a flow of oil, gas, water or present or to fix at a target depth, since the presence of the flow generates a considerable expulsive force.

Another known device is an inflatable cementer unit that consists of a first expandable tubular element with a pair of ends, the first pair of ring terminal supports to fix corresponding ends of the first tubular element relative to the mandrel located in the first tubular element, one of the terminal supports being mobile and the other terminal support being fixed relative to the mandrel. The first fixing ring unit deploys from one of the terminal supports to reinforce the first tubular element while creating pressure inside it and its extension, hinged to one of the terminal supports with one of its ends to reinforce the first tubular element while creating pressure inside it and its extension, capable of expansion at its other end and containing multiple plates disposed in a ring configuration, hinged to mobile terminal support with one of their ends and each having a width increasing from its hinged end to its other end (see RU 2384692).

This device can be used for temporary isolation of a part of a borehole, but cannot be used for killing a flowing well, since it does not have means either to introduce a kill fluid into the hole at some depth and against the flow of oil or to fix at a target depth, since expansion of tubular elements causes a considerable increase in expulsive force.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF EMBODIMENTS OF THE INVENTION

Figure 1:
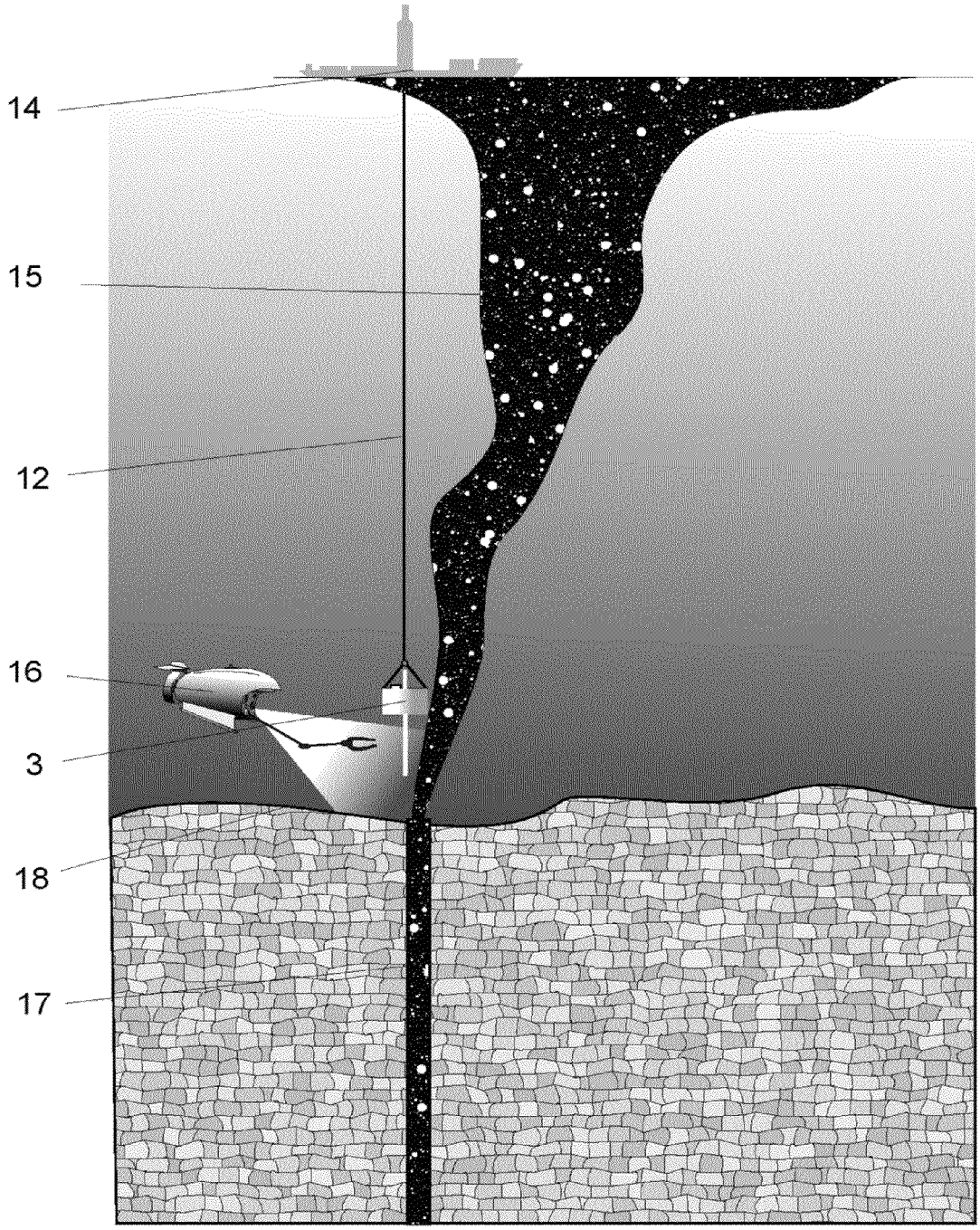
FIG. 1 illustrates the lowering of the device into a well having an underwater wellhead.

The object of the invention and its corresponding technical result includes a decrease in a volume of materials and expense for well killing and also for providing a possibility of an emergency killing of a flowing underwater well.

The technical result is provided by squeezing of a cementing composition into the well, based on a preliminary estimation of the well state and pressure therein, and is achieved by determination of the size of the well section to be cemented, and the depth of the injector installation in the well. The injector is fixed on a tank of a cementing composition and placed into a bag made of flexible material, is kept underwater and inserted into the head of the drop-out well at a target depth. The bag is filled in with a cementing composition from the tank with the help of the injector, providing for a firm contact of an outer surface of the bag with an inner surface of the well section. The injector is held at a target depth by the weight of the whole structure filled with the cementing composition. After squeezing, the pressure in the bag is kept up until the cementing composition hardens.

In addition, the injector is inserted into the wellhead directly or through an open emergency preventer with the help of a robot or a bathyscaphe;

The weight of the tank with the cementing composition is chosen so that it has sufficient force expelling the injector from the well during the cementing composition squeezing;

Bag dimensions, the material it is made of, and the pressure of cementing composition squeezing are chosen so that the bag having been filled with the cementing composition inserted into the well section's inner surface and is up against the well's inner surface with its outer surface.

The approach provides a possibility of emergency killing of a blowing well by overcoming a force of fluid flow while the device inserting down to the target depth and the volume of the device increases.

The proposed device and method achieves the beneficial result due to the fact that the device includes a pipe and an expandable element. The pipe is inserted into the wellhead, and includes a tank with a cementing composition. The tank is fixedly coupled to the pipe. The tank also includes a piston, which separates the internal volume of the tank into two portions. The first portion is filled with the cementing composition, and is connected to the pipe in order to pump the cementing composition into the expandable element. The second portion of the volume is provided with the capability of being filled with sea water. The pipe is provided with a blanked off lower end. The expandable element is made of a flexible material, with a possibility of filling its internal volume with the cementing composition through an opening in a side wall of the pipe.

Additionally, the length of the pipe is selected such that the expandable element can be located in the wellhead without damaging the sides of the wellhead, and has a length that is sufficient to reliably kill the well.

Additionally, the expandable element is in the form of a bag or sack, that is substantially cylindrical in shape, and is wrapped with elastic belts in its initial state.

The tank is provided with holding elements in order to suspend it on a rope, and is provided with a possibility of moving its center of gravity, so as to change the angle or orientation of the entire construction.

The tank is also provided with guides to guide the movement of the piston.

The internal volume of the first portion of the tank is connected to the internal volume of the pipe through a valve or a controlled gate, in order to prevent a premature leakage of the cementing composition under its own weight along the expandable element.

The second portion of the volume of the tank is provided with a pump and a cable for controlling the pump from a surface vessel.

The structure is also provided with an electrical motor, a video camera, and a light projection system for control of the structure from a surface vessel.

The lower bearing face of the pipe is provided with a conical/tapered tip (plug).

The end portion of the expandable element is fixed to a spring loaded sleeve, which is mounted on the pipe, which provides for movement of this element along the pipe when the expandable element increases in volume.

The task that the present invention solves is providing for a possibility of an emergency killing of a flowing well by overcoming the pressure from the fluid flow when the inventive device is inserted to a certain depth within the well and the expandable element is expanded in volume. In another embodiment, the result is achieved because the device includes a pipe and an expandable element. The tank containing a cementing composition is inserted into the wellhead, and is fixedly connected to the pipe. The tank is provided with a piston which divides the internal volume of the tank in to at least two volumes. The first volume is filled with the cementing composition and is connected to the internal volume of the expandable element. The second portion is provided with a possibility of filling it with sea water. The expandable element is formed of a flexible material, with a possibility of filling its internal volume with the cementing composition from the tank. The expandable element encloses the lower portion of the pipe. The upper portion of the pipe is provided with a blocking unit and an element for mounting a pipeline.

Additionally, the length of the pipe was chosen such that the expandable element can be located on a portion of the well with its sides intact, and has a length that is sufficient to reliably kill the well.

The expandable element is in the form of a bag or sack, generally cylindrical shaped, and is wrapped with elastic belts in its initial state.

The tank is provided with fixation elements for hanging it on a rope. The fixation elements provide a possibility of moving the center of gravity, in order to change the angle of orientation of the entire structure.

The internal volume of the first portion of the tank is connected to the internal volume of the expandable element through a valve and a movable gate, in order to prevent a premature leaking of the cementing composition due to gravity in to the expandable element.

The second portion of the volume of the tank is provided with a pump and a cable for controlling the pump from a surface vessel.

The portion of the pipe inside the tank is in the form of guides for movement of the piston.

The locking element is placed in the upper portion of the pipe and is intended to provide a path for fluids, such as oil and gas, and for pumping the cementing composition in to the well.

The construction is provided with a motor and a video camera, and a headlight for control of the device from the surface vessel.

The butt of the expandable element is fixed on a sleeve that is spring loaded, which is mounted on the pipe. The butt of the expandable element is able to move along the length of the pipe when the volume of the expandable element increases. The tank includes membrane valve in each of the sidewalls, in order to equalize the pressure in the volumes relative to the surroundings.

INDUSTRIAL USE

Figures 2, 3:
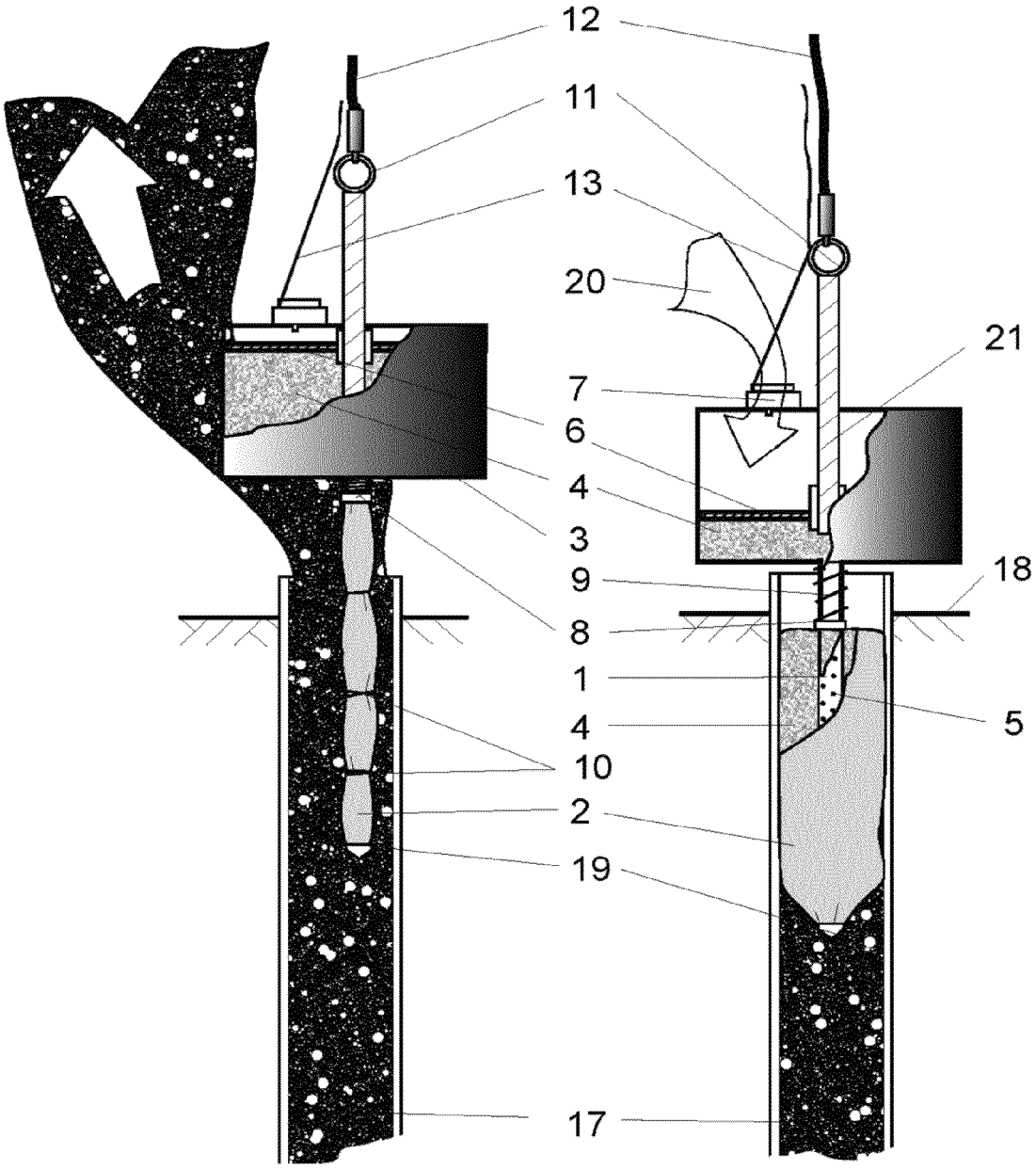
FIG. 2 illustrates a first embodiment of the device for emergency killing of a well having an underwater head position, at a moment when the device is inserted into the well.
FIG. 3 illustrates the first embodiment, showing the structure of the device at a moment when the cementing composition is being squeezed.
Figure 4:
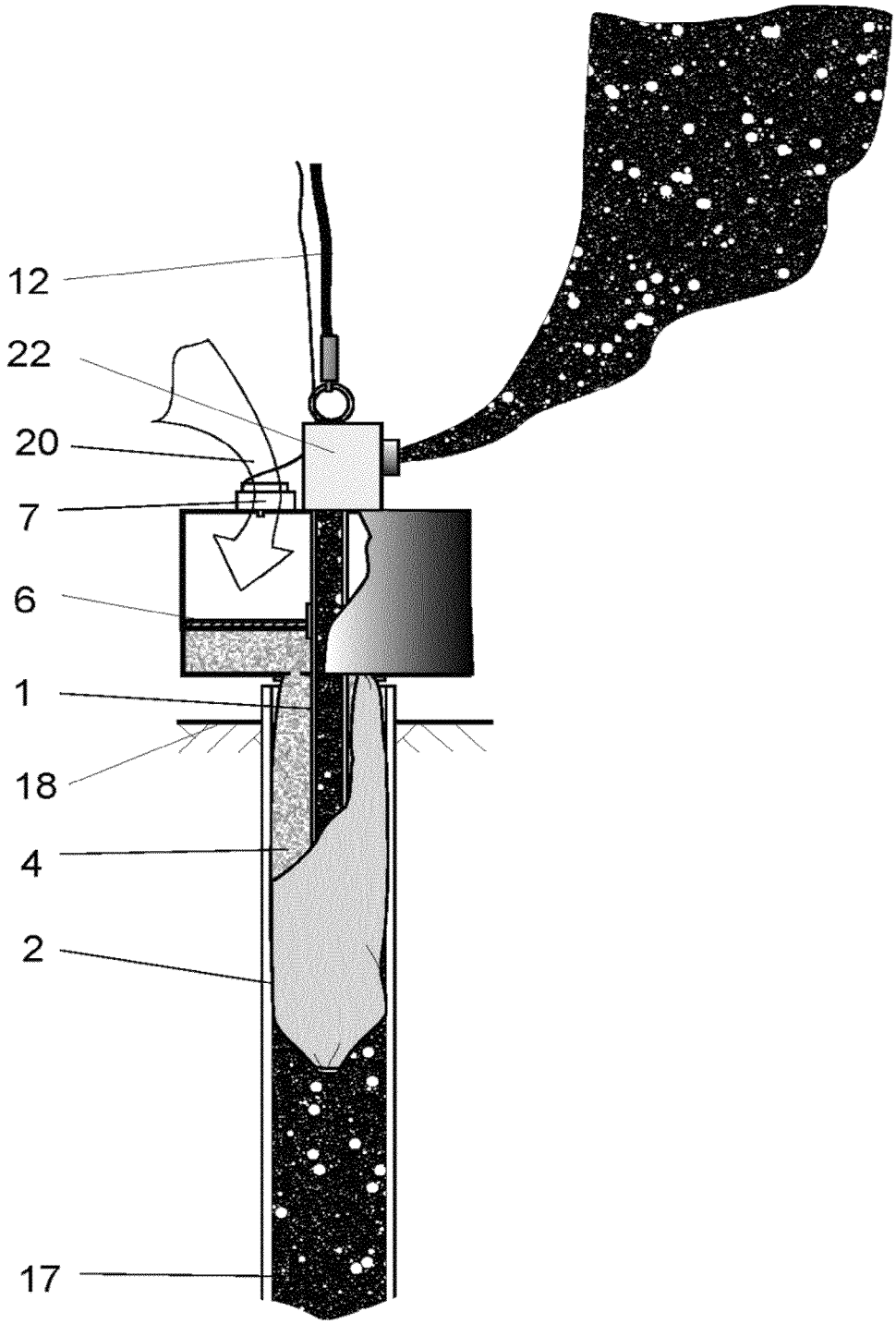
FIG. 4 illustrates a second embodiment of a device for emergency killing of a well having an underwater head position.

The invention is further explained by using the drawings, where FIG. 1 illustrates the lowering of the device into a well having an underwater wellhead. FIG. 2 illustrates the structure of a first embodiment of the device, that implements the method of emergency killing of a well having an underwater head position, at a moment when the device is inserted into the well. FIG. 3 illustrates the device in its first embodiment, showing the structure of the device at a moment when the cementing composition is being squeezed. FIG. 4 illustrates a device of the present invention in a second embodiment, illustrating the method of emergency killing of a well having an underwater wellhead.

The following designations are used in the drawings:

1—pipe,
2—expandable element—such as a bag,
3—tank,
4—cementing composition,
5—holes in the pipe sidewall (perforation),
6—piston,
7—pump for outside water squeezing,
8—spring-loaded sleeve,
9—spring,
10—elastic belts,
11—holders,
12—lowering cable,
13—cable for pump control,
14—above-water apparatus,
15—gush of fluids from the well,
16—robot or bathyscaph to install injector into a wellhead,
17—well,
18—sea bottom level,
19—lower pipe end,
20—water,
21—piston guide,
22—blocking unit with pipeline detachable holding elements for fluid pumping-out or cementing composition squeezing.

The method for emergency killing of a well having an underwater wellhead position includes bottoming an injector fixed on a tank that has a cementing composition inside it, and which is located inside a bag made of a flexible material. The bag is able to take on a shape of an inner surface of the well while increasing its volume, see FIG. 1. The method further includes inserting the bag into the wellhead of a failed well down to a target depth, squeezing the cementing composition from the tank into the bag through the injector, keeping the injector at the target depth by using the weight of the entire structure filled with the cementing composition, and maintaining the pressure in the bag while the cementing composition hardens.

The injector injected into the wellhead either directly or through an open emergency preventer, by using a row bud or a bathyscaph.

The weight of the structure that is filled with the cementing composition is selected so that it exceeds the force on the injector that attempts to expel the injector out of the well, while the cementing composition is being squeezed. The dimensions of the bag and the pressure during the time when the cementing composition is squeezed are chosen so that the bag with the cementing composition fills the inner volume of the well, assuming its shape, and the external surface of the bag fits snuggly against the inner surface of the well.

The method for emergency killing of the well having an underwater wellhead is implemented as follows:

A vessel, or some sort of a surface craft that is provided with a lifting gear or mechanism is placed over a failed well. A tank with an injector having an elongated form and enclosed by a bag made of flexible material, and having generally a cylindrical shape) is lowered to the wellhead using a rope. Due to the flexibility of the material of the bag, the bag can assume the shape of the inner surface of the well while expanding in volume, due to the cementing composition being squeezed into the bag from the tank through the injector. The injector is also inserted into the failed wellhead down to the target depth. A robot or a bathyscaph that has a manipulator arm is used to insert the injector. The injector is mounted on a tank, and the weight of the structure exceeds the force exerted by the oil in the upward direction, in other words, the fluid inside the well is being forced down by the weight of the injector and the tank. The injector, once placed at the depth within the oil well casing where the casing is not supposed to have been destroyed, or where the decay of the casing is considered acceptable, the cementing composition is then squeezed into the bag, and the bag expands, filling the inner volume of the section of the well. Pressure in the bag is maintained by using a pump, until the cementing composition hardens.

The expandable element, once expanded, has its flexible material tightly pressing against the inner sidewalls of the well, notwithstanding any irregularity in the inner surface of the well.

Once the cementing composition has been hardened, the bag that contains the cementing composition functions in the manner of a plug that fills the failed well section, and stays at the target depth thanks to the weight of the structure, the friction of the material of the bag against an inner surface of the sidewalls of the well, and any preventer sidewalls irregularities that are filled in by the bag.

The depth at which the cementing takes place must be chosen such that it is sufficient for reliable killing of the well, and the cemented well section length provides distribution of adhesive force to the inner surface of the well, to permit resisting any pressure of the liquid running out of the well.

Example 1

For an emergency killing of an underwater well, an injector is made and mounted at the bottom of a tank containing a cementing composition. The injector is wrapped in a bag made of flexible plastic that generally has a cylindrical shape in its expanded form. The injector's length is such that the injector can be lowered to the level of the well section that still has intact sides of the casing column. In typical cases, this length may be at least 10 to 20 meters.

A failed emergency valve is removed, and the remainder of the pipe is cut away at the bottom. Then, the injector that is fixed on the tank is lowered down on a rope from a vessel, and is brought to the opening of the well with help of a robot.

Once the injector is completely lowered, the tank butts the upper edge of the casing column, the preventer, or the bottom of the sea. A pump is turned on, and the upper chamber of the tank is flooded with seawater. Under the pressure generated by the pump, a piston is pushed down and forces out (extrudes) the cementing composition from the tank, through the injector and into the bank, increasing the inner volume of the bad, which in turn fills the volume of the shaft of the well. The weight of the structure that includes the cementing composition can be tens of tons, which prevents the injector being pushed out by pressure from the well and the oil, gas, or other fluids outputted by the well.

The bag (expandable element) is made of a flexible material, and once enlarged, it generally follows the inner surface of the well, which provides for keeping the bag in place once the cementing composition hardens.

The pressure inside the bag is maintained by the pump until the complete hardening of the cementing composition, so that a plug formed in this manner keeps the fluid from exiting the well, and the well can be considered killed.

The cementing composition is not washed out by the flow of the fluid in the well, unlike the conventional situation, since the cementing composition is located in the enclosed space of the expandable element. The amount of the cementing composition is defined by the volume of the expandable element, the weight of the cementing composition and the pressure created by the pump, all of which combined provide for resisting the force of the fluid from the well until a complete hardening of the cementing composition.

The method described above can be implemented by using standard devices, such as tanks, pipes, etc., and electrical appliances, such as pumps, a tugger, etc.

Thus, the described method provides for emergency killing of an underwater well, as well as for reducing the amount of cementing composition necessary, as well as for reducing the cost of killing the well and the cost of post-accident cleanup.

The method for emergency killing of an underwater well, as shown in the first embodiment can be implemented by a device that includes a pipe (see FIG. 2), an expandable element, such as a bag, a tank for cementing composition, and for water, the tank being rigidly connected to a pipe. The pipe is perforated, with a plugged lower end, which is provided with a tapered tip in order to insert the pipe in order to more easily insert the pipe into the well. Capacity of the tank is selected so that the weight of the tank, once filled with the cementing composition, exceeds the force of the flow of the liquid exiting the well. The expandable element is made of a flexible material that forms an enclosed space. The tube is mounted inside the expandable element, and the tank is provided with a piston that divides the inner volume of the tank into two chambers. The first chamber is filled with the cementing composition and is connected to the pipe for injecting the composition into the expandable element. The second chamber is provided with a pump for injecting outside seawater into the chamber.

The length of the pipe is selected to permit the expandable element to be located in a section of the well that has intact or undamaged sides.

The expandable element is initially tied with elastic belts, and the tank is provided with holders or fixing elements to attach it to a rope. The belts and the holders provide a capability to shift the center of gravity of the structure, so that to change the angle of entry into the well, if necessary.

The upper portion of the perforated pipe includes a valve, such as an electromagnetic valve, to prevent the discharge of the cementing composition under its own weight into the expandable element.

The pump and the valve are provided with a cable to enable controlling the devices from a surface vessel.

The structure is provided with an electric motor, a video camera and a search light to control the device from the surface vessel. The tank includes guides for movement of the piston. The butt of the expandable element is mounted on a spring loaded sleeve, which is mounted in the pipe, and can move along the pipe when the expandable elements volume is increasing. The length of the pipe is chosen so that the size of the expandable element is sufficient to reliably kill the well. Membrane valves are installed on sidewalls of the tank, for each chamber, to balance the pressure in the tank with the pressure in the outside environment.

The device for emergency killing of an underwater well, according to the first embodiment, works as follows:

The first chamber of the tank is filled with a cementing composition. The second chamber is intended for outside seawater, and once filled with seawater, cannot be deformed while being lowered to the proper depth. The device, in its working condition, hangs on a rope or cable, and is placed above the location of a failed well from a surface vessel. An elongated holding element keeps the device in a stable vertical orientation while it hangs from the cable. If the wellhead is tilted, or at an angle, the angle of orientation of the structure is changed by shifting the suspension point, and, therefore, the center of gravity. By using a robot, or a bathyscaph, the pipe is mounted to the bottom of the tank and is directed to the wellhead. After that, the device is placed down into the well. The device may be provided with controlled motors, video cameras and search lights in order to achieve a necessary spatial orientation through commands from a surface vessel, which may avoid the use of robots.

In its initial state, the expandable element is stretched by a spring loaded sleeve, and, under the pressure of the surrounding environment. In this matter, the expandable element envelopes the pipe without sagging, also, the expandable element is tied with several elastic belts or snaps, to prevent sagging while the device is being prepared above water, and in order to reduce resistance while it is being inserted into the well. Membrane valves balance pressure in a tank with surrounding environmental pressure, to prevent hydraulic shock while the motor is being switched on, and opening of the electromagnetic valve one close to the sea bottom.

The weight of the structure, filled with the cementing composition, is sufficient to overcome the force of the liquid from the well. The length of the pipe is selected so that it can reach a depth where the casing column sidewalls are intact, or a depth where the well sidewalls damage is considered to be tolerable, for reliably killing the well. When the device is completely inserted into the well, the tank butts against the casing column or the preventer butt with its lower part, or settles to the ground.

Once the device is inserted into the well, the pump is switched on, and forces outside seawater into the corresponding chamber of the tank (see arrow in FIG. 3), creating overpressure, which pushes the piston, which in turn pushes out the cementing composition into the pipe. The piston moves along its guide, which enable movement of the piston parallel to the walls of the tank.

Since the pipe has its sidewalls perforated, the cementing composition can flow from the pipe into the expandable element, whose volume increases. Thus, the pipe with its perforated sidewalls acts as an injector. The range of movement of the spring loaded sleeve, to whose upper end the expandable element is fixed, makes the expandable element increase in its internal volume. The expandable element, which is made of an elastic material, is filled with a cementing composition, which forces the sleeve to travel along the pipe, which in turn permits the expandable element to gain in volume.

While the cementing composition is being injected, the expandable element diameter increases, and the elastic belts around it stretch or snap, so that they don't prevent the expandable element from increasing in volume.

The sidewalls of the expandable element are made of a flexible material, so that, once filled with the cementing composition, the expandable element presses against the inner walls of the well, filling any surface irregularities, and providing for secure fixation of the device in the well, once the cementing composition hardens.

During the time necessary for the cementing composition to harden, pressure is maintained in the expandable element by a pump, so as to overcome any force of the fluid flow from the well.

Once the cementing composition is hardened, the device becomes a reliable barrier for the fluid leaving the well, and the well can be considered killed.

The device can be made of sheet metal or sectional metal through machining, together with a cloth type material such as Kevlar, and elements such as water pump, electric motor, etc.

The claimed device therefore provides for emergency killing of a failed well by overcoming the force of the fluid flow from the well while inserting the device to the target depth in the well, and increasing the volume of the expandable element. The device as claimed also prevents the washing out of the cementing composition from the well while the well is being killed.

FIG. 4 illustrates another embodiment of the device for implementing emergency killing of an underwater wellhead, including an expandable element, a tank for cementing composition and water, which is mounted rigidly on a pipe that goes to the tank. The expandable element is made in a form of a bag of flexible material, that, once expanded, forms a closed volume in the shape of approximately a cylinder. Tank capacity is selected so that its weight, once filled with the cementing composition, overcomes the force of the flow of the fluid from the well. The upper portion of the pipe includes a locking unit to pump out oil products, or to squeeze the cementing composition into the well. The locking unit is provided with a releasable joint with a pipeline for pumping out the oil or squeezing in the cementing composition. The tank is provided with a piston, which divides its inner volume into two chambers. The first chamber is filled with a cementing composition and is in communication with the inner volume of the expandable element. The second chamber is provided with a pump for pumping water.

The length of the pipe is selected so that the expandable element can be placed in a section of the well that has undamaged sidewalls.

The expandable element is tied with elastic belts or snaps, and the tank is provided with holders for hanging it on a rope or cable, so that the structure is capable of shifting its center of gravity in order to change the angle of orientation of the structure.

The device also includes a valve, such as an electromagnetic valve, to prevent unwanted discharge of the cementing composition into the expandable element under the weight of gravity.

The chamber in the tank for pumping outside seawater is provided with a pump and a cable for controlling the pump from a surface vessel.

The pump and the electromagnetic valve are also provided with a cable to control them from a surface vessel. The structure is also provided with an electric motor, a video camera and a search light, which can be controlled from the surface vessel without using a robot.

The pipe inside the tank is used as a guide to move the piston. The length of the pipe is chosen so that the size of the expandable element is sufficient to reliably kill the well. Membrane valves are installed on the sidewalls of the tank to balance the pressure in each chamber with the pressure in the surrounding environment.

The device according to the second embodiment works as follows:

One of the chambers of the tank is filled with a cementing composition. The other chamber is intended for seawater, and is filled with water to prevent it from deforming while being forced down to a preset depth into the well. The device, in its working condition, hangs on a rope or cable and is brought to the location of the failed well using a surface vessel. An elongated holding element enables the device to keep its stable vertical orientation while it hangs from a cable. If the wellhead is at an angle. The angle of orientation of the device can be changed by shifting a suspension point, and, consequently, the center of gravity of the device. By using a robot or a bathyscaph, the pipe, which is located below the tank, is directed to the wellhead, and the device is put down in to the well. The device may be provided with motors, video cameras and search lights, to assist in changing its spatial orientation from a surface vessel, and without the use of a robot or bathyscaph.

The expandable element, in its initial condition, is rolled up and tied with elastic belts or snaps in several places, to prevent sagging while the device is above water, and to reduce resistance while the device is going down into the well. The hollow pipe locking unit is open. Membrane valves balance pressure in the tank with pressure in the surrounding environment, preventing any hydraulic shock, when the motor is switched on, and the electromagnetic valve opens close to the sea bottom. A valve or a gate between the tank and the expandable element is locked, to prevent the cementing composition from going into the expandable element.

The weight of the structure filled with the cementing composition and with the hollow pipe opened in its initial state, permits overcoming the force of the fluid from the well which might affect the expandable element. The diameter of the pipe is chosen based on the requirement to reduce the force affecting the expandable element due to the fluid flow discharge through it: the larger its inner diameter, the smaller the force. The length of the pipe is chosen so that it can reach the depth where the sidewalls of the casing column are intact, or to a depth where damage or destruction of the sidewalls can be considered tolerable or acceptable. When the device is placed into the well completely, the lower part of the tank butts against the casing column or the preventer butt, or settles to the sea bottom.

Once the device is placed into the well, the pump is switched on, and pumps outside seawater in to the corresponding tank chamber (see arrow in FIG. 4), which creates an overpressure, which in turn pushes the piston, which in turn pushes out the cementing composition in to the expandable element through a corresponding connection, where the valve or the gate between the tank and the expandable element is open. The piston travels inside the tank along the pipe, using the pipe as a guide.

The cementing composition from the tank moves into the expandable element, whose volume increases. Fluid flow can freely discharge through the pipe into the sea, reducing the force from the fluid from the well that affects the expandable element.

While the volume of the expandable element is increasing, elastic belts can stretch or snap, so that they do not prevent the expandable element from increasing in volume. The expandable element is made of a flexible material, so that when it is filled with the cementing composition, it presses against the inner walls of the well, filling in any surface irregularities, and providing for secure fixation of the device in the well, once the cementing composition hardens.

The cementing composition, once hardens, the locking unit mounted on the end of the pipe is shut down, or used to pump out excess liquid or excess cementing composition, to achieve the complete killing of the well. The pipeline is connected to it through a locking unit of detachable joints. The claimed device can be made of a durable cloth, such as Kevlar, sheet or sectional metal by machining it, together with such elements as the water pump, electric mother, etc. Thus, the claimed device provides for emergency killing of a failed well by overcoming the force of the fluid flow of oil products that affect the expandable element. The use of the device prevents washing out of the cementing composition from the well, and provides for controlled access to the borehole passage.

Having thus described the different embodiments of a system and method, it should be apparent to those skilled in the art that certain advantages of the described method and system have been achieved. It should also be appreciated that various modifications, adaptations, and alternative embodiments thereof may be made within the scope and spirit of the present invention. The invention is further defined by the following claims.

What is claimed is:

1. A method of emergency killing of an underwater well, the method comprising:

squeezing a cementing composition, wherein the well section to be cemented and depth of injector installation are preliminarily sized up, based on underwater well condition and pressure therein, fixing an injector on a tank;

filling a tank with the cementing composition;

placing the injector in a bag made of a flexible material;

delivering the injector, the bag and the tank to a sea bottom into proximity of the underwater well;

inserting the injector to a target depth into a wellhead of the underwater well and filling the bag with the cementing composition from the tank; and hardening the cementing composition, wherein the injector is held at the target depth in the wellhead by a combined weight of the cementing composition, injector and the tank; and maintaining pressure in the bag while the cementing composition in the bag is hardening.

2. The method of claim 1, wherein the injector is inserted into a wellhead directly or through an open emergency preventer by a robot or a bathyscaph.

3. The method of claim 1, wherein the weight of the tank filled with cementing composition overcomes a force of liquid flowing from the well.

4. The method of claim 1, wherein the hardening step is performed while the bag maintains adherence to an outer surface of the well's inner surface.

5. The method of claim 1, wherein the filling is performed through the injector.

6. A device for emergency killing of an underwater well, comprising:

a pipe and an expandable element coupled to the pipe;

a tank for a cementing composition and rigidly connected to the pipe, the tank and the pipe located in proximity to the underwater well on a sea bottom;

a piston in the tank dividing the tank at least into first and second chambers;

the first chamber is filled with the cementing composition;

the second chamber is accessible to outside seawater, wherein the expandable element is made of a flexible material and is fillable with the cementing composition.

7. The device of claim 6, wherein the expandable element is fillable with the cementing composition through a hole in a sidewall of the pipe.

8. The device of claim 6, wherein the pipe length is chosen so that the expandable element could be located in the well section with intact sidewalls and has a length sufficient for a reliable well killing.

9. The device of claim 6, wherein the expandable element is a bag in a substantially cylindrical shape when expanded, and is tied with elastic belts in its unexpanded condition.

10. The device of claim 6, wherein the tank is provided with holders for hanging on a going-in rope that are made to let the centre of gravity to shift and permit the device's orientation to change.

11. The device of claim 6, wherein an inner volume of the first chamber of the tank is connected to the inner volume of the pipe by a valve or a controlled gate to prevent a preliminary cementing composition bleeding into the expandable element under its own weight.

12. The device of claim 6, wherein the second chamber of the tank is coupled to a pump and a cable for controlling the pump from a surface vessel.

13. The device of claim 6, wherein the lower bearing face of the pipe is provided with a tapered tip-plug.

14. The device of claim 6, wherein the butt of the expandable element is fixed on a spring-loaded sleeve which is mounted on the pipe and is adapted to move along the pipe to increase volume of the expandable element.

15. The device of claim 6, wherein each chamber includes a membrane valve in each of a sidewall of the tank to balance inside pressure and outside pressure.

16. The device of claim 6, wherein the first chamber is connected to the pipe for squeezing the cementing composition into the expandable element.

17. The device of claim 6, wherein the pipe has a closed lower end.

18. The device of claim 6, wherein the first chamber of the tank is connected to the expandable element through a valve or a controlled gate.

19. The device of claim 6, wherein the expandable element envelopes a lower part of the pipe, and the upper part of the pipe includes a blocking unit and pipeline holding elements.

20. The device of claim 6, wherein a section of the pipe located inside the tank guides movement of the piston.

* * * * *